United States Patent [19]

Lansing

[11] 4,425,602

[45] Jan. 10, 1984

[54] UMBRELLA LAMP ASSEMBLY

[76] Inventor: Lawrence A. Lansing, 120 W. Sirius St., Anaheim, Calif. 92802

[21] Appl. No.: 292,346

[22] Filed: Aug. 13, 1981

[51] Int. Cl.[3] ..... F21L 7/00

[52] U.S. Cl. ..... 362/186; 362/102; 362/190; 362/191; 362/196; 362/311; 362/355; 362/360; 362/361; 362/363

[58] Field of Search ..... 362/102, 186, 190, 191, 362/196, 311, 355, 360, 361, 363

[56] References Cited

U.S. PATENT DOCUMENTS

| | | | |
|---|---|---|---|
| 2,651,710 | 9/1953 | Clark | 362/196 |
| 3,258,589 | 6/1966 | Doring | 362/186 |
| 4,020,858 | 5/1977 | Wilson | 362/102 |
| 4,174,532 | 11/1979 | Kelley | 362/102 |

*Primary Examiner*—Stephen J. Lechert, Jr.
*Attorney, Agent, or Firm*—Thomas R. Vigil

[57] ABSTRACT

The umbrella lamp assembly is adapted for mounting to an umbrella stem and includes a hollow body comprising first and second light transmitting shells. The shells are coupled together by an assembly which permits opening of the shells for placing the hollow body around an umbrella stem and which urges the shells toward each other. The shells have recesses at the top and bottom thereof for receiving and accommodating the umbrella stem in a frictional manner. A lamp is mounted in the hollow body and a mounting for receiving a battery is provided in the hollow body. A switch is mounted to one shell and is electrically coupled to the lamp and to a battery mounted in the hollow body.

12 Claims, 8 Drawing Figures

FIG. 1
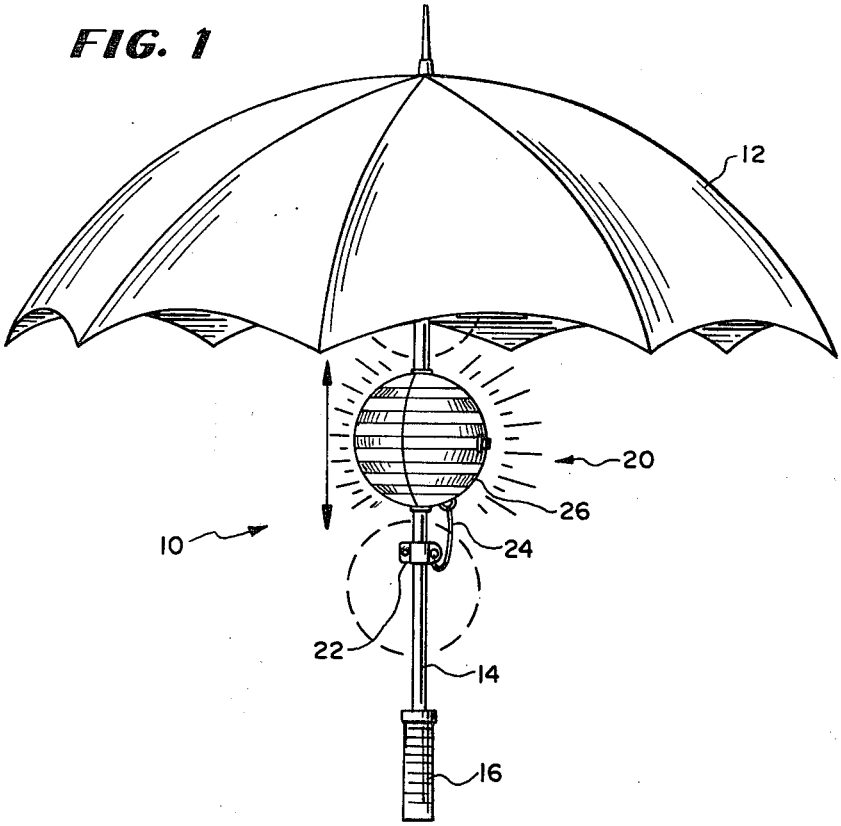
FIG. 2
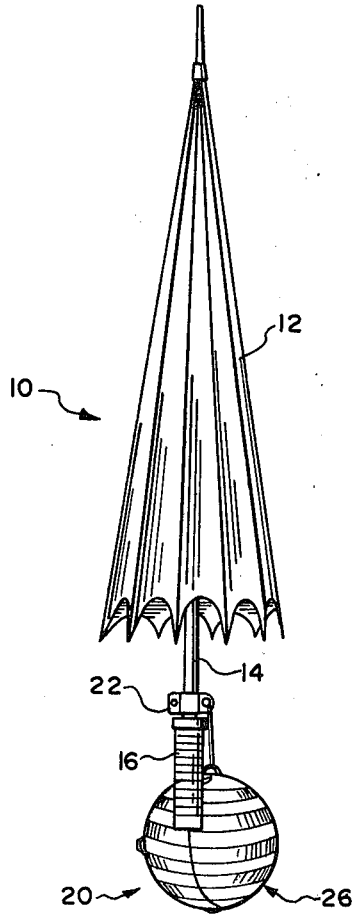
FIG. 3
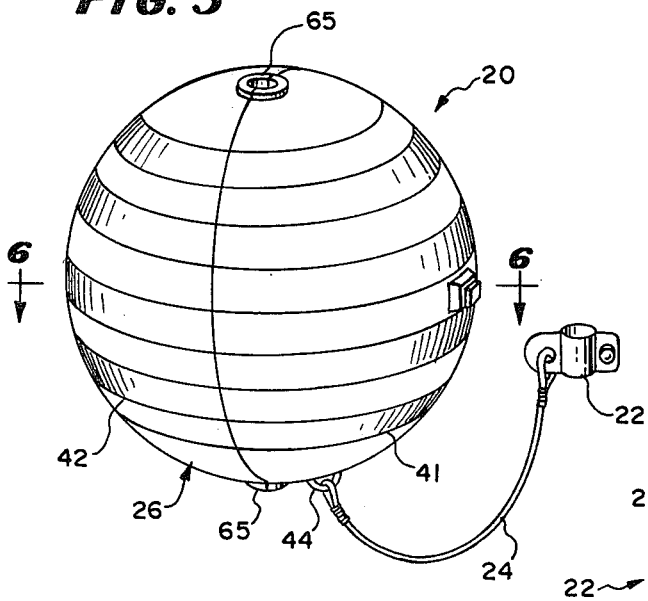
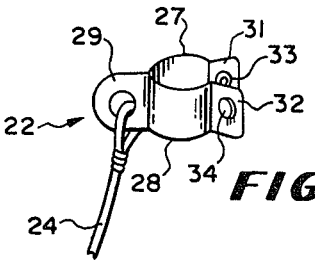
FIG. 4

UMBRELLA LAMP ASSEMBLY

BACKGROUND OF THE INVENTION

1. Field of the Invention

The present invention relates to a lamp assembly for mounting to the stem of an umbrella to provide illumination while walking in the rain at night.

2. Description of the Prior Art

Heretofore various lamp assemblies have been proposed for providing light underneath an umbrella. For example, in U.S. Pat. No. 2,372,471 there is disclosed an illuminated umbrella which includes a lamp assembly in the handle of the umbrella.

Similarly, in U.S. Pat. No. 3,281,586, there is disclosed an umbrella light mounted in the handle of an umbrella for projecting a light beam from the lower end of the handle of the umbrella.

Further there has been proposed in U.S. Pat. No. 2,087,537 and U.S. Pat. No. 4,174,532 lamp assemblies or lighting fixture assemblies for mounting to a garden umbrella which is mounted in a garden or outdoor area in association with a table.

The garden umbrella lamp assembly disclosed in U.S. Pat. No. 2,087,537 is fixed to the garden umbrella which is specially configured to have the lamp assembly mounted therein either in an opened or closed position of the umbrella web.

The lamp assemblies in the umbrella handles disclosed in U.S. Pat. No. 2,372,471 and No. 3,281,586 are formed integrally with the handle of the umbrella.

The portable lighting fixture disclosed in U.S. Pat. No. 4,174,532 permits the lighting fixture to be easily mounted on the supporting umbrella struts within an open garden umbrella and easily removed therefrom as well.

As will be described in greater detail hereinafter, the umbrella lamp assembly of the present invention is constructed, arranged and designed to be releasably received about and in frictional engagement with an umbrella stem and differs in this configuration and mounting from the previously proposed lighting fixtures or lamp assemblies for use with an umbrella structure, whether it be a hand carried umbrella or a garden umbrella.

Moreover, the umbrella lamp assembly of the present invention differs from the previously proposed lamp assemblies by providing an easily mountable lamp assembly for mounting on the stem of an umbrella with a self-contained power supply such as a battery therein and which can be mounted on existing hand-carried umbrellas without any modification of the umbrella. Additionally, the umbrella lamp assembly of the present invention includes a hollow, transparent or translucent body which can be colored, if desired, such as with bands of colors of the rainbow thereon, and received about the stem of the umbrella.

SUMMARY OF THE INVENTION

According to the invention there is provided a portable lamp assembly having a self-contained power supply therein and being adapted for mounting to an umbrella stem, said assembly comprising a generally spherical hollow body including first and second light transmitting shells, means for coupling said shells together in a manner permitting opening and closing of said shells for placing said shells about an umbrella stem and then closing the shells about the umbrella stem, said shells having recesses at the top and bottom thereof for receiving and accommodating the umbrella stem, means associated with said recesses for frictionally engaging the stem, a lamp, means for mounting said lamp completely within said hollow body, means for mounting a battery in said hollow body, means for electrically coupling said lamp to a battery mounted completely within said hollow body, a switch mounted to said first shell, and means for electrically coupling said switch to said lamp and to a battery mounted in said hollow body.

BRIEF DESCRIPTION OF THE DRAWINGS

FIG. 1 is a side elevational view of an open umbrella having the lamp assembly of the present invention mounted on the stem thereof.

FIG. 2 is a side elevational view of a closed umbrella with the lamp assembly of the present invention suspended from the lower end of the stem by a clip.

FIG. 3 is a perspective view of the lamp assembly of the present invention.

FIG. 4 is a perspective view of the mounting clip for the lamp assembly shown in FIG. 3.

DESCRIPTION OF THE PREFERRED EMBODIMENT

Figure 5:
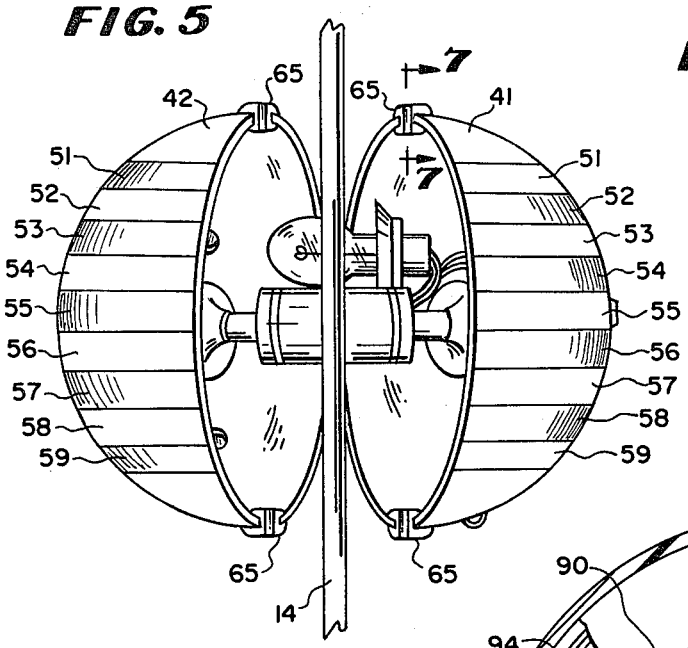
FIG. 5 is a side elevational view of the lamp assembly of the present invention in a partially open position for being received about an umbrella stem.
Figure 7:
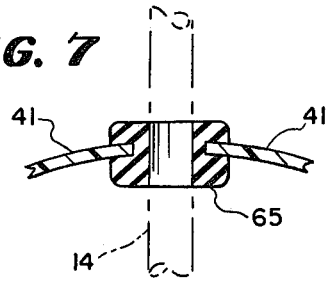
FIG. 7 is a sectional view taken along line 7—7 of FIG. 5 and shows an elastomeric grommet mounted in a recess in a shell of the assembly for frictionally engaging a stem of an umbrella.

Referring now to the drawings in greater detail there is illustrated in FIG. 1 an umbrella 10 having an expandable, collapsible web 12 mounted on a stem 14 having a handle 16. The expandable, collapsible web 12 has a hub (not shown) which is movable telescopically on the stem 14.

The umbrella 10 is shown in an open position in FIG. 1 with a lamp assembly 20 made in accordance with the teachings of the present invention mounted on the stem 14. As will be described in greater detail hereinafter, the lamp assembly 20 is constructed in a simple manner to enable the lamp assembly 20 to be easily mounted on the stem 14 and frictionally held on the stem 14 as shown. Also, to facilitating carrying of the lamp assembly 20 with the umbrella 10, the assembly 20 includes a clip 22 connected by a cord 24 to the semi-spherical body 26 of the lamp assembly 20.

In FIG. 1 the clip 22 is shown fastened about the stem 14 beneath the lamp assembly 20.

As shown in FIG. 4, the clip 22 has two arm portions 27 and 28 which are mirror images of each other and which extend from a mounting portion 29. The arm portions 27 and 28 are configured with a concave portion to fit about the stem 14 of the umbrella 10. Also, each arm portion 27 and 28 has an end portion, 31 or 32 which has a fastener 33 or 34.

The fasteners 33 and 34 can be of the snap-type to facilitate a releasable snap-fastening of the clip 22 about the stem 14.

In use, and as shown in FIG. 2, when the umbrella is not being used and is to be carried, the web portion 12 is collapsed as shown after the lamp assembly 20 has been removed from the stem 14. If the umbrella construction permits, the clip 22 can merely be slid down from the position shown in FIG. 1 to the position shown in FIG. 2. However, many umbrella constructions have a spring-biased detent (not shown) within the stem 14 connected to the hub (not shown) which, when the web portion 12 is collapsed, is slid downwardly within the stem 14 to a slot in the stem 14. The detent, then under the action of the spring, moves into the slot and locks the web portion 12 in a lowered, collapsed position as shown in FIG. 2.

As a result of this construction, it may be necessary to remove the clip 22 momentarily to collapse the umbrella and then remount it by means of the mating snap fasteners 33 and 34 on the stem in the position shown in FIG. 2.

Figure 6:
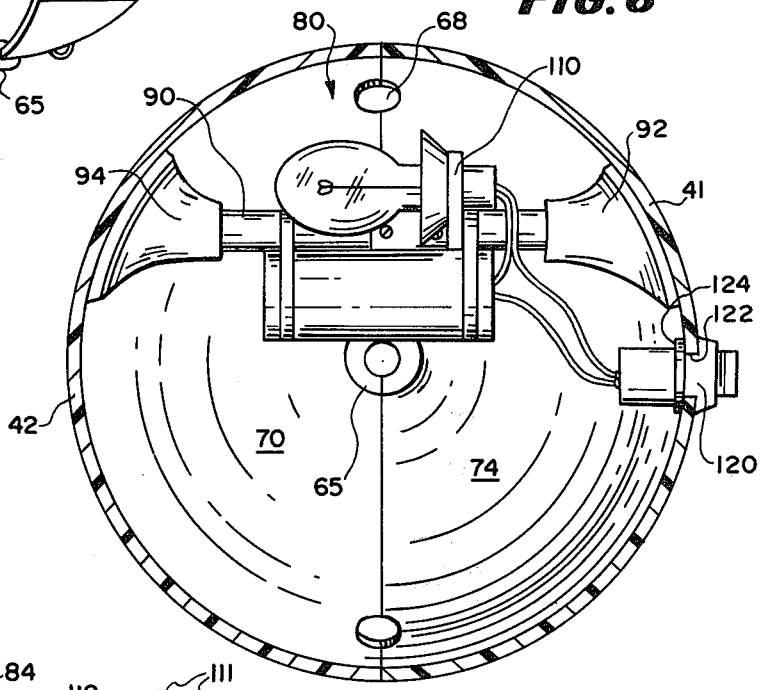
FIG. 6 is a sectional view of the lamp assembly taken along line 6—6 of FIG. 3.

In accordance with the teachings of the present invention and as shown in FIGS. 3, 5 and 6, the lamp assembly 20 comprises the hollow, spherical body 26 which is made of two mating semi-spherical shells 41 and 42. Each of the shells 41 and 42 is preferably made of a plastic material. In one embodiment, the plastic material is transparent and in another embodiment, the plastic material is translucent. Also, in some embodiments, the plastic material will be a clear, transparent plastic which is not coated or painted. In yet another embodiment, the shells 41 and 42 are pigmented or colored so as to provide a translucent, solid colored or multicolored spherical body 26.

In still a further embodiment, the shells 41 and 42 are made of a clear plastic material and have colors in bands 51–59 painted thereon, such color bands 51–59 being the colors of the rainbow.

Figure 8:
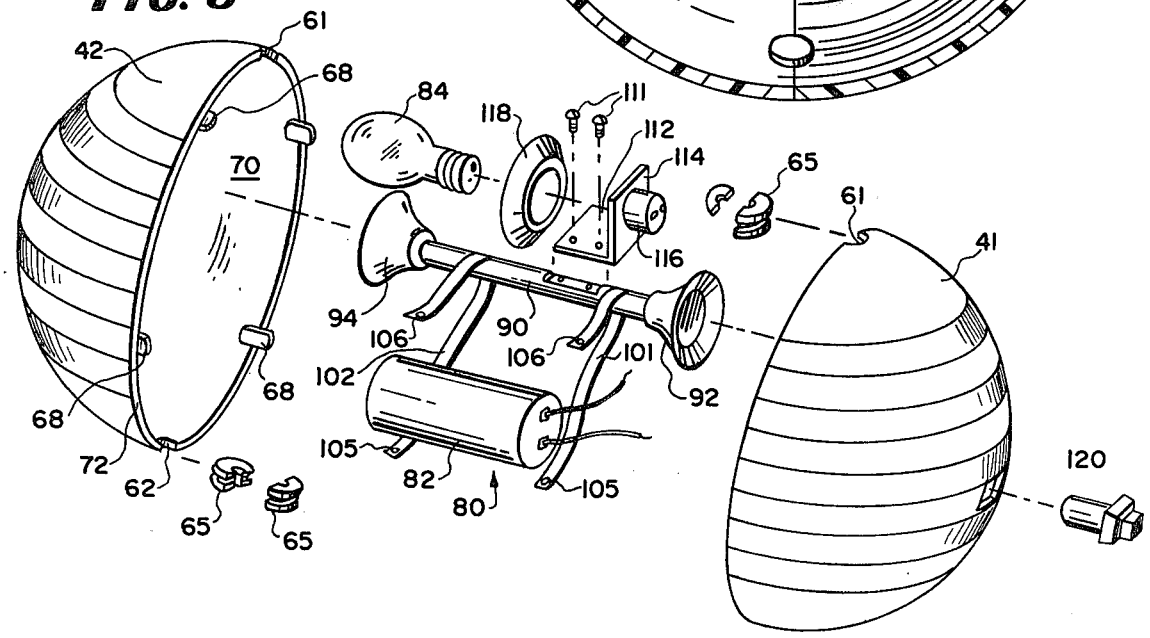
FIG. 8 is an exploded perspective view of the parts of the lamp assembly of the present invention.

As shown, each of the shells 41 and 42 has a semi-cylindrical recess at the top and bottom thereof such as the recesses 61 and 62 in shell 42 as best shown in FIG. 8. Received within each of the recesses 61 and 62 is a semi-annular grommet 65 which is made of an elastomeric material and which is adapted to resiliently and frictionally engage the stem 14 of the umbrella 10.

One of the shells 41, 42 such as shell 42, has formed thereon four detents or projections 68 which extend from the inner surface 70 of the shell adjacent the circular edge 72 of the shell and outwardly from the circular edge 72 of the shell so as to be received within the shell 41 and against the inner surface 74 thereof thereby to form alignment, locating and abutment members. In this way, proper alignment and locating of the shell 41 relative to the shell 42 is ensured with the projections or detents 68 engaging the inner surface 74 of the inner shell 41 when they are brought together about an umbrella stem 14.

Mounted within and between the shells 41 and 42 is a multifunction assembly 80 for mounting a battery 82 within the hollow body 26, for mounting a lamp 84 within the hollow body 26, and for resiliently holding the shells 41 and 42 together about an umbrella stem 14 while at the same time permitting the shells 41 and 42 to be moved apart for mounting or dismounting the lamp assembly 20 from the stem 14 of an umbrella 10.

As best shown in FIG. 8, the assembly 80 includes a bar 90 having mounted at each end thereof an elastomeric member 92 or 94 in the shape of a rubber suction cup. In a prototype made of the lamp assembly 20, the elastomeric members 92 and 94 were cut from a nipple for a baby bottle. Each elastomeric member 92 and 94 was adhered to one end of the bar 90 and to the inner surface 74 or 70 of the shell 41 or 42. By being made of an elastomeric material, the members 92 and 94 enable the shells 41 and 42 to be pulled apart for placing the shells 41 and 42 over a stem 14. At the same time, the elasticity or resiliency of the elastomeric members 92 and 94 enable them to serve as means for pulling the shells 41 and 42 together to hold them in place to form the spherical body 26 about the umbrella stem 14.

As shown in FIG. 6, the assembly 80 is mounted to one side of the hollow spherical body 26 to enable the stem 14 to pass through the hollow body 26.

The bar 90 also forms a base member for means for mounting the battery 82. In the illustrated embodiment, such means take the form of two straps 101 and 102 which are adhered to the bar 90 at spaced apart locations thereon as shown in FIG. 8. Each strap 101 and 102 is made of a flexible elastic material and has some form of fastening means such as snap fasteners 105 and 106 at the ends thereof to enable the straps 101 and 102 to be secured about opposite ends of the battery 82 for holding the battery 82 to the bar 90.

As an alternative to the straps 101 and 102, bracket members made of a thin, strap-like material which is stiff but yet resilient can be fixed at spaced apart locations to the bar 90 to form mounting brackets for the battery 82. In such an embodiment, each bracket would have end portions which releasably mate and lock with each other and which can be opened or closed by moving a portion of the bracket to unlatch the end portions thereof. In this way, with stiff but resilient bracket members, the battery 82 can be releasably and simply mounted within the hollow body 26 to the mounting bar 90.

Also as shown in FIG. 8, an L shaped mounting bracket 110 is secured to the bar 90 such as by fasteners 111 received through a mounting flange portion 112 of the bracket 110. The bracket 110 also has an upright portion 114 holding or mounting a socket 116. If desired, a reflector 118 can also be secured to the upright portion 114 such that the lamp 84 is received through the reflector 118 and into the socket 116. In this way, a very simple arrangement is provided for mounting the lamp 84 on the bar 90 within the hollow body 26 of the lamp assembly 20.

As best shown in FIGS. 6 and 8, the shell 41 has a pushbutton switch 120 received through an opening 122 in the shell 41 and then secured therein by means of a suitable fastening ring such as a snap ring 124.

The pushbutton switch 120 is connected by a lead or conductor 131 to the battery 82 and by a lead or conductor 132 to the lamp 82. Also a lead 133 is connected between the lamp 84 and the battery 82. When the switch 120 is closed, a series circuit is established from the positive side of the battery 82 through the switch 120, the lamp 84 and then back to the negative side of the battery 82.

Although one form of lamp and battery mounting assembly 80 has been described above and illustrated in the drawings, it is to be understood that another form of battery and/or lamp mounting assembly can be provided in the lamp assembly 20. Also, other means besides the bar 90 and the elastomeric members 92 and 94 can be provided for hingedly coupling the shells 41 and 42 together so as to permit opening of the shells 41 and 42 for placing the shells 41 and 42 about the stem 14 of an umbrella 10 and for holding the shells 41 and 42 in place about the stem 14.

From the foregoing description it will be apparent that the lamp assembly 20 of the present invention has a number of advantages, some of which have been described above and others of which are inherent in the invention. Also, it is apparent that many modifications can be made to the lamp assembly 20 without departing from the teachings of the present invention. Accordingly, the scope of the invention is only to be limited as necessitated by the accompanying claims.

I claim:

1. A portable lamp assembly having a self-contained power supply therein and being adapted for mounting to an umbrella stem, said assembly comprising a generally spherical hollow body including first and second light transmitting shells, means for coupling said shells together in a manner permitting opening and closing of said shells for placing said shells about an umbrella stem and then closing said shells about the umbrella stem, said shells having recesses at the top and bottom thereof for receiving and accommodating the umbrella stem, means associated with said recesses for frictionally engaging the stem, a lamp, means for mounting a battery in said hollow body, means for electrically coupling said lamp to a battery mounted completely within said hollow body, a switch mounted to said first shell, and means for electrically coupling said switch to said lamp and to a battery mounted in said hollow body.

2. The lamp assembly according to claim 1 wherein said hollow body is spherical in shape and said shells are semi-spherical in shape to provide a sphere shaped lamp assembly about the umbrella stem.

3. The lamp assembly according to claim 1 wherein said hollow body is made of clear plastic material.

4. The lamp assembly according to claim 1 wherein at least a portion of said hollow body is translucent and colored.

5. The lamp assembly according to claim 1 wherein said hollow body is translucent and/or transparent and has the colors of the rainbow.

6. The lamp assembly according to claim 1 wherein each of said recesses in each of said shells is semicircular and said means for frictionally engaging the stem comprise four semi-annular grommets that are received respectively in one of said recesses.

7. The lamp assembly according to claim 1 wherein said coupling means and said means for mounting said lamp includes a bar and first and second flexible elastomeric mounting members at each end of said bar, each elastomeric mounting member being adhered at one end to said bar and at the other end to the inner surface of one of said shells.

8. The lamp assembly according to claim 7 wherein said means for mounting a battery include said bar and a pair of spaced apart straps fixed to said bar, each strap having means at an outer end for releasably mating with the other end of said strap for holding a battery to said bar.

9. The lamp assembly according to claim 7 wherein said means for mounting a battery in said hollow body include said bar and a pair of spaced apart clamps secured to said bar, each clamp being configured to receive one end of a battery therein and having means for releasably holding one end of a battery therein.

10. The lamp assembly according to claim 7 wherein said lamp mounting means include a bracket member fixed to said bar and having a socket mounted thereon for receiving said lamp.

11. The lamp assembly according to claim 1 wherein at least one of said shells has at least one detent which is situated on the inner surface of said shell and which extends beyond the edge of said shell to form a locating, alignment and abutment member for locating and aligning said shells in proper alignment to form said hollow body.

12. The lamp assembly according to claim 1 including a clip and a cord connected at one end to one of said shells and at the other end to said clip, said clip having two resilient arm portions which are adapted to be spread apart to permit said clip to be placed around an umbrella stem and each arm portion having releasable mating fastening means at the outer end thereof for fastening said clip on the umbrella stem.

* * * * *